US006833837B2

(12) United States Patent
Hei La

(10) Patent No.: US 6,833,837 B2
(45) Date of Patent: Dec. 21, 2004

(54) DITHERING METHOD AND DITHERING DEVICE

(75) Inventor: Gerard David Hei La, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 169 days.

(21) Appl. No.: 10/153,259

(22) Filed: May 22, 2002

(65) Prior Publication Data

US 2003/0016231 A1 Jan. 23, 2003

(30) Foreign Application Priority Data

May 23, 2001 (EP) ..... 01201976

(51) Int. Cl.[7] ..... G09G 5/02

(52) U.S. Cl. ..... 345/589; 345/600; 345/605; 345/690

(58) Field of Search ..... 345/600, 605, 345/60–72, 690, 589

(56) References Cited

U.S. PATENT DOCUMENTS

| | | | | |
|---|---|---|---|---|
| 5,404,176 A | | 4/1995 | Lum | 348/574 |
| 5,619,227 A | * | 4/1997 | Takebe | 345/690 |
| 6,034,664 A | * | 3/2000 | Ali-Santosa et al. | 345/593 |
| 6,069,609 A | * | 5/2000 | Ishida et al. | 345/596 |
| 6,243,072 B1 | * | 6/2001 | McKnight | 345/690 |

* cited by examiner

*Primary Examiner*—Matthew C. Bella
*Assistant Examiner*—Manucher Rahmjoo
(74) *Attorney, Agent, or Firm*—Edward W. Goodman

(57) ABSTRACT

A dithering method limits a digital value of a pixel to N bits, wherein the image signal includes a pixel value of M bits, wherein M is greater than N(M>N). A pseudo-random number (M−N) of bits is added to an original pixel value of M bits, the result of the addition is then truncated at N bits, wherein the random values which are added to two or more adjacent pixels values are mutually correlated.

10 Claims, 3 Drawing Sheets

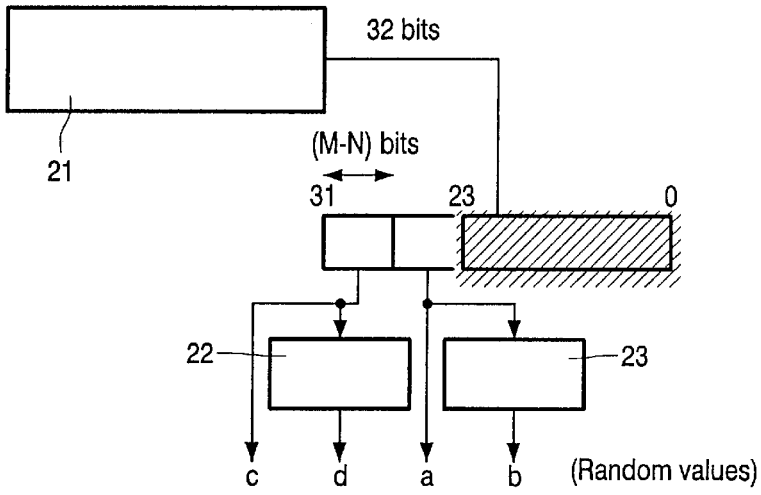
FIG. 2
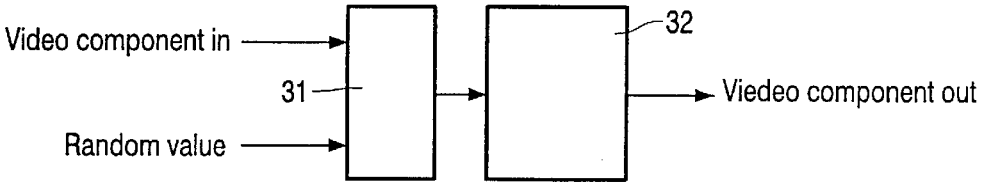
FIG. 3
| | | | | |
|---|---|---|---|---|
| Video component | R0 | R1 | R2 | R3 |
| Random value | c | d | a | b |
| Video component | G0 | G1 | G2 | G3 |
| Random value | a | b | c | d |
| Video component | B0 | B1 | B2 | B3 |
| Random value | b | a | d | c |
FIG. 4

DITHERING METHOD AND DITHERING DEVICE

BACKGROUND OF THE INVENTION

1. Field of the Invention

The present invention relates to a dithering method and a dithering device. Particularly in the case of Plasma Display Panels (PDPs), but also in the case of other devices, such as, Plasma Addressed Liquid Crystals (PALCs), one of the problems which occurs is that because of physical limitations, the number of bits available for a pixel value of a particular color cannot be displayed in sufficient depth. Due to lack of time, six to eight bits per image cycle are, for instance, possible in the case of PDPs, while the (color) information is available in, for instance, ten to twelve bits.

2. Description of the Related Art

Dithering algorithms are known, such as that of Floyd-Steinberg, error diffusion etc., for compensating truncation errors.

It is known, for instance, from U.S. Pat. No. 5,404,176, to add a bit value of a color component (R, G, B) and a random number, and thus compensate for a truncation error.

SUMMARY OF THE INVENTION

It is an object of the present invention to provide a good dithering method and dithering device, wherein the calculations are not very complex and the required hardware and/or software can remain limited.

The present invention provides a dithering method for assigning a digital value of N bits to a color component of a pixel, wherein the image signal comprises a pixel value of M bits, wherein M is greater than N(M>N), wherein a (pseudo-)random number of (M−N) bits is added to an original pixel value of M bits, the result of the addition then being truncated at N bits, and wherein the two or more random values which are added to two or more adjacent (color) pixel values are mutually correlated.

According to the present invention the (software) computation for dithering noise can be combined with the gamma correction, which is especially important for PDPs. If combined with gamma correction, the algorithm, according to the present invention, adds 27 MHz instead of 119 MHz for the Floyd-Steinberg algorithm of computing capacity for a processor of 1000 MHz, e.g., a load of less than 3% instead of about 12% relative to the capacity of the processor.

Two of the random numbers are preferably each other's inverse, and more preferably, four random numbers originate from a common random generator wherein pairs of the numbers are each other's inverse. So-called 'blue noise' is hereby obtained in a higher frequency range than if the values were uncorrelated, which is advantageous for the Human Visual System (HVS).

In order to keep the total luminance value of successive pixels as constant as possible, the respective different mutually correlated random numbers are added as far as possible to the respective pixel values for red (R), green (G) and blue (B) of successive pixels.

The present invention further provides a dithering device which particularly makes use of a plasma display panel.

BRIEF DESCRIPTION OF THE DRAWINGS

Further advantages, features and details of the present invention will be elucidated on the basis of the following description of a preferred embodiment thereof with reference to the accompanying drawings, in which:

FIG. 2 shows a block diagram of a preferred embodiment of the applied method;

FIG. 3 shows a block diagram of a preferred embodiment of the applied device;

FIG. 4 shows a table of the addition of the different values of color components of successive pixels in a video image obtained from the block diagram of FIG. 2.

DESCRIPTION OF THE PREFERRED EMBODIMENTS

Figure 1:
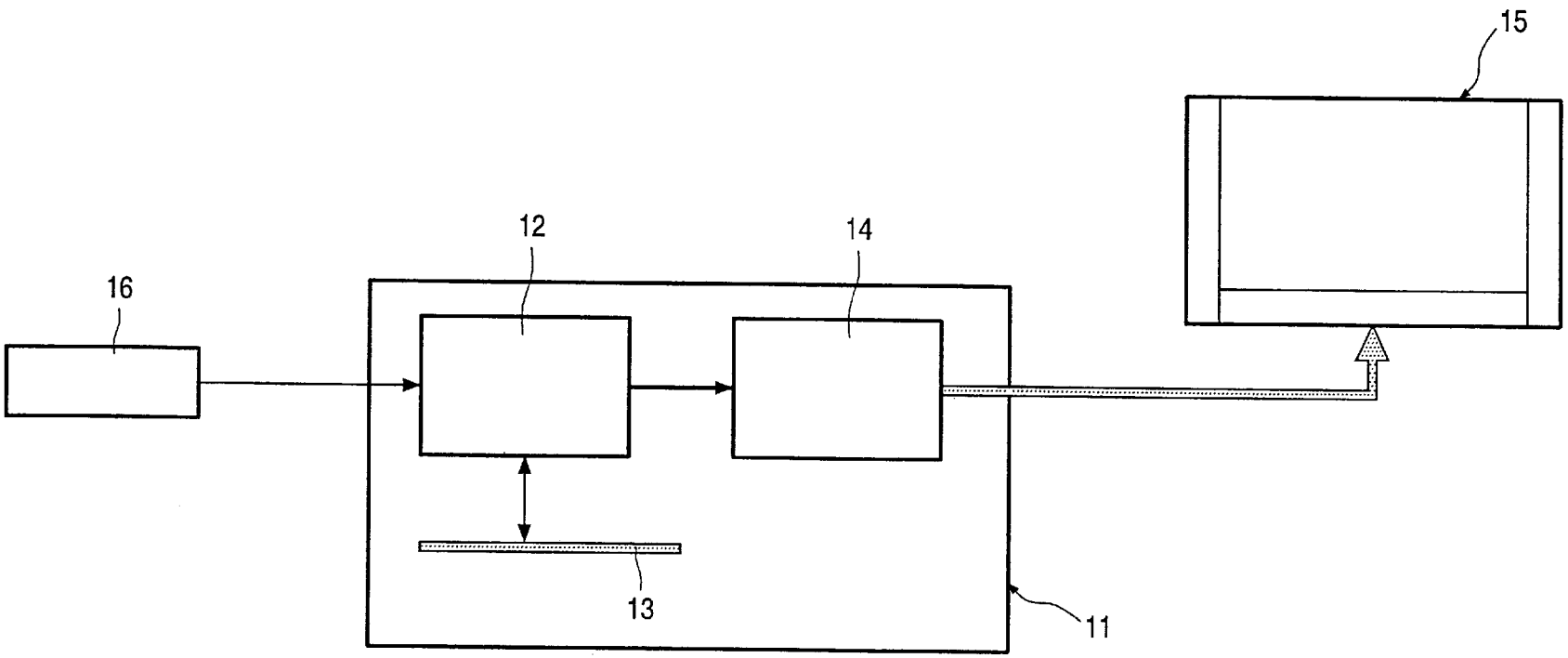
FIG. 1 shows a block diagram of a preferred embodiment of a hardware configuration wherein a method and device according to the present invention are applied.

A host personal computer (PC) 11 is provided with a so-called TriMedia TM 1100 development board 12 which is connected to an internal bus 13 of the host PC and a custom PDP interface 14 for connecting to a schematically designated Plasma Display 15, and is connected to a video source 16 which generates an analog signal (for instance, CVBS or YC format signals) which is converted, in the TriMedia board, to a digital signal, for instance, in a YUV 4:2:2 interlaced video stream. The TriMedia processor converts this image into progressive RGB data (of 8 bits per color, i.e., a 24 bit RGB signal).

In the preferred embodiment, a linear congruential generator 21 (FIG. 2) supplies a pseudo-random number of 32 bits, for instance, according to the formula:

$$X_{n+1}=(A\times X_n+C)(\text{modulo } 2^{32})$$

The longest possible period of the generator is obtained for A=1, 5, 9, 13(1(mod4)) and C being odd. From the more significant part of the generated pseudo-random number, two pseudo-random numbers of (M−N) bits are obtained, c and a, respectively, while inverted values d and b, respectively, are also obtained therefrom by means of inverter 22 and 23, respectively.

The more significant bits of the output of the generator 21 are even less correlated than the less significant bits thereof.

In the present embodiment, the number M is, for instance, 12 and the number N is for instance, 7, so that two numbers of 5 bits are added as noise in an adder 31 (FIG. 3), whereafter, the sum is truncated in truncating member 32, a 'video component out' (R, G or B) of 7 bits being supplied as a video component to the PDP display 15.

By likewise applying the inverted values b and d, the noise is formed to a higher frequency range, which is less disturbing to the Human Visual System.

Figure 5A:
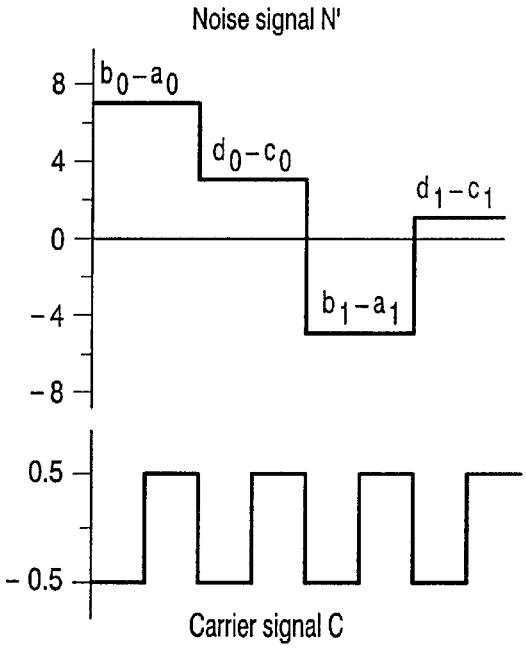
FIGS. 5A, 5B and 5C are graphs of an example of high frequency blue noise included in the embodiment of FIGS. 1–3.
Figure 5B:
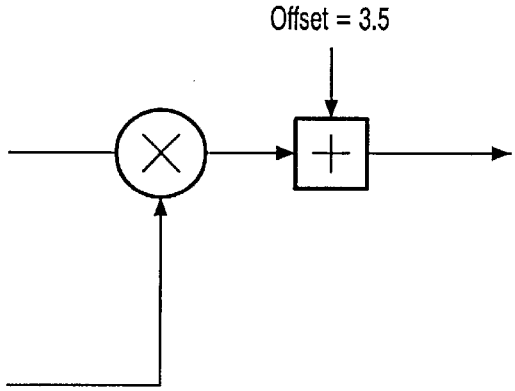
Figure 5C:
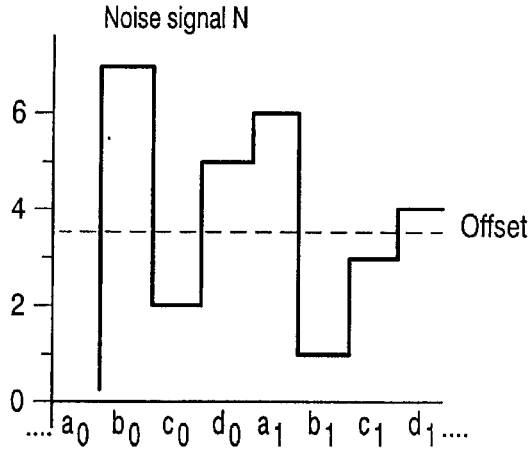

The mutually correlated values a–d are obtained after a single iteration to the noise generator 21, whereby so-called 'blue noise' is obtained (FIGS. 5A, 5B and 5C). An example of a noise signal N (FIG. 5C) is, for instance, added to a G (or R or B) 'video component in'. This signal N can be decomposed into a noise signal N' and modulating carrier wave C.

As shown in FIG. 4, the values a, b, c and d are added to the color signals R0–R3, G0–G3 and B0–B3 of four successive horizontal pixels such that two of these adjacent color values at a time are mutually correlated, which has the above-stated advantageous effect on the Human Visual System.

In accordance with this diagram, the luminance Y (=0.3R+0.59G+0.11B) is moreover maintained for adjacent pixels (FIGS. 5A, 5B and 5C).

The present invention is not limited to the above described preferred embodiment; the rights sought are however defined by the following claims, within the scope of which many modifications can be envisaged, especially with respect to the possible exchange of hardware and software for certain parts of the device (and method).

What is claimed is:

1. A dithering method for limiting a digital value of a pixel to N bits, in which an input image signal has pixels having pixel values of M bits, where M is greater than N, wherein the method comprises the steps:

generating pseudo-random numbers of (M−N) bits;

adding the pseudo-random numbers to pixel values of pixels of the input image signal; and truncating each of the results of the addition to N bits, wherein the pseudo-random number added to pixel values of two or more adjacent pixels are mutually correlated.

2. The method as claimed in claim 1, wherein the pseudo-random numbers added to the pixel values of two adjacent pixels are each other's inverse.

3. The method as claimed in claim 1, wherein the pseudo-random numbers added to the pixel values of four adjacent pixels originate from a common random generator, and wherein pairs of the pseudo-random numbers are each other's inverse.

4. The method as claimed in claim 3, wherein each input pixel includes color pixel values for red, green and blue, and wherein different mutually correlated pseudo-random numbers are added to the red, green and blue color pixel values of each pixel.

5. The method as claimed in claim 4, wherein the pseudo-random values are to the color pixel values for red, green and blue of the four adjacent pixels such that two of the adjacent color pixel values at a time are mutually correlated.

6. The method as claimed in claim 1, wherein noise formed by the dithering due to mutual correlation is in a relatively higher frequency range than dithering without said mutual correlation.

7. A device for performing the method of claim 1, wherein the device comprises:

a display member; and electronics connected to a display member, wherein the electronics comprises:

a noise generator for supplying a pseudo-random number of a predetermined number of bits; and means for adding and truncating the addition of the random values to an input video component.

8. The device as claimed in claim 7, wherein the noise generator supplies three or four pseudo-random values and the adding and truncating means adds said three or more random values to the R, G and B color signals of an input video signal.

9. The device as claimed in claim 7, wherein the display is a plasma display panel.

10. The device as claimed in claim 7, wherein a method for assigning a digital value of N bits to a pixel, wherein the image signal comprises a pixel value of M bits, wherein M is greater than N(M>N), wherein a (pseudo-)random number of (M−N) bits is added to an original pixel value of M bits, the result of the addition is then truncated at N bits and wherein the random values which are added to two or more adjacent (color) pixel values are mutually correlated is used.

* * * * *